United States Patent [19]

Yanagimoto et al.

[11] 4,006,618

[45] Feb. 8, 1977

[54] METHOD OF PRODUCING SEAMLESS STEEL TUBE

[75] Inventors: Samon Yanagimoto; Minoru Kawaharada; Seishiro Yoshiwara; Susumu Mizunuma; Motoaki Sugiyama, all of Kitakyushu, Japan

[73] Assignees: Samon Yanagimoto; Nippon Steel Corporation, Tokyo, Japan

[22] Filed: July 21, 1975

[21] Appl. No.: 597,812

[30] Foreign Application Priority Data

Dec. 28, 1974 Japan ..... 50-149151

[52] U.S. Cl. ..... 72/10; 72/13; 72/19; 72/209; 72/251

[51] Int. Cl.[2] ..... B21B 19/04; B21B 37/00

[58] Field of Search ..... 72/97, 208, 209, 10, 72/13, 12, 19, 250–252

[56] References Cited

UNITED STATES PATENTS

| | | | |
|---|---|---|---|
| 3,245,241 | 4/1966 | Roberts | 72/12 X |
| 3,511,070 | 5/1970 | Tselikov et al. | 72/209 |
| 3,570,582 | 3/1971 | Calm | 164/76 |
| 3,587,263 | 6/1971 | McCarthy | 72/8 |

*Primary Examiner*—Milton S. Mehr
*Attorney, Agent, or Firm*—Wenderoth, Lind & Ponack

[57] ABSTRACT

In a method of producing seamless steel tube from billet having a square or rectangular cross-section by the step of piercing a workpiece and rolling steps following the piercing step, each of such steps being conducted with a plug held by a mandrel toward the center of cross section of the workpiece while the workpiece is rolled by a pair of rolls with axes arranged horizontally. The piercing step includes guiding the workpiece by a plurality of pairs of guide rolls provided along the rolling line ahead of the rolling rolls as the billet is forced therethrough to maintain the billet in such a position that the hollow shell will not have any nonuniformity of wall thickness and piercing workpiece with a plug as the workpiece is pushed and inserted between the rolling rolls under the forced guidance by a pushing force working in the axial direction, and as the plug progresses into the center of cross section of the workpiece, so as to pierce the workpiece, thereby producing seamless steel tube having very little nonuniformity of the wall thickness.

12 Claims, 28 Drawing Figures

NONUNIFORMITY
F2/F1
NONUNIFORMITY OF WALL THICKNESS AND F2/F1
CLEARANCE BETWEEN BILLET AND INSIDE WALL OF THE CONTAINER(δ)

15
15-1
15-2
3-1
3-2
2
4
4'
5
6
7
8
10

21
22
23
24
25
26
27
28
29
31
32
3
33
34
3-2
35
3-1
36
37
38
39
40
41

METHOD OF PRODUCING SEAMLESS STEEL TUBE

BACKGROUND OF THE INVENTION

The present invention relates to a method of producing seamless steel tube, particularly a method of producing seamless steel tube from billet having a square or rectangular cross-section by using a press roll piercer.

Conventionally and generally the production of seamless steel tube is carried out mainly by subjecting round billet to piercing by a Mannesman piercer; rolling the billet into a hollow shell by an elongator; and finishing by a plug mill. Such production methods use round billets as the starting material, and the supply of such billets requires a special continuous casting system, which constitutes one of the problems in the effort to reduce material cost.

In addition, the piercing step using the Mannesman piercer operates under such conditions as a 5–10% expansion percentage and a percent 1.5 – 2.5 elongation ratio, making it difficult to apply to alloy steel. Therefore, if it is used as the material for said step, the round billet of carbon steel should be free from surface defects, inclusions and any other irregularities.

After having been pierced by the piercer, the hollow shell is expanded and elongated by the elongator of the same type as the piercer. Generally in such an operation, the elongation ratio and the expansion ratio are respectively 2 – 3 and 10 – 20%; therefore, any nonuniformity in the wall thickness of the hollow shell resulting from the previous step may be increased by the operation of the elongator.

Particularly in the case of producing a hollow shell of very small wall thickness, the increased rolling load at the elongator makes it generally necessary to reduce the slant angle of the rolls, resulting in a rolling speed of 0.2 – 0.3/sec in the axial direction. This means that the temperature drop in this step is so great as to require a reheating process before the rolling by the plug mill.

In addition to the abovementioned seamless steel tube production process, there is a process practised by using a Pilger mill. According to this process, a piece of square or rectangular cross-section material (mostly ingots) is inserted into a container, and subjected to press piercing by an Ehrhardt piercing process as it is inserted; then it is roughed in the abovementioned elongator and finished in the Pilger mill. However, this process is greatly inferior to the plug mill process with respect to rolling efficiency, preciseness of dimensions and surface quality.

When round billet is used as the material for steel tube production, the material cost increases as described above. This problem has apparently been solved by a recent improvement of the above-described press process, according to which part of the container is replaced by rolls, and which is named the press roll piercing process, thereby making it possible to produce round hollow shell from a billet of square or rectangular cross-section. However, even this process is not free of the problem of the non-uniform wall thickness of the hollow shell in the circumferential direction.

SUMMARY OF THE INVENTION

The present invention has solved the problems as described above arising from the conventional methods for producing seamless steel tube.

Therefore, it is an object of the present invention to provide a method for producing seamless steel tube having very little nonuniformity of the wall thickness, from a material of square or rectangular cross-section.

Another object of the present invention is to provide a method of producing seamless steel tube of high quality without failure of piercing even of a billet of material of comparatively low quality.

A further object of the present invention is to provide a method of producing seamless steel tube, which can be carried out without a reheating process particularly in the case of producing a small wall thickness seamless steel tube, thereby reducing equipment construction cost and economizing on thermal energy consumption.

In order to attain said objects, the method of producing seamless steel tube according to the present invention comprises the step of piercing a workpiece and a rolling step following the piercing step, each of such steps being conducted with a plug held by a mandrel toward the center of the cross section of the workpiece while the workpiece is rolled by a pair of rolls with the axes arranged horizontally. The piercing step comprises guiding the workpiece by a plurality of pairs of guide rolls provided along the rolling line ahead of said rolling rolls as the billet is forced therethrough so as to maintain the workpiece in such a position that the hollow shell will not have any nonuniformity of the wall thickness, while at the same time piercing the workpiece with the plug as the workpiece is pushed through the roll pass defined by said rolls by a pushing force in the axial direction.

DESCRIPTION OF THE PREFERRED EMBODIMENTS

Figure 1A:
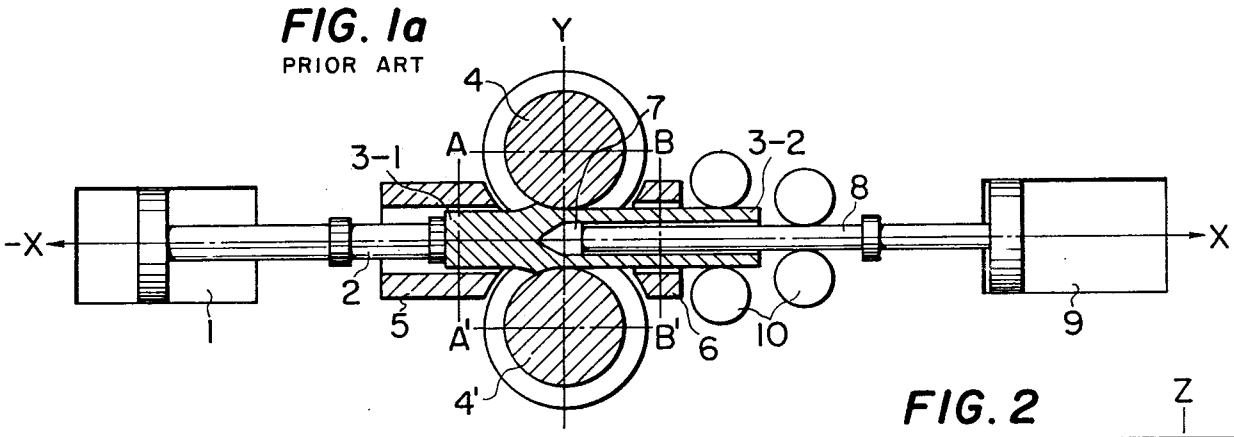
FIG. 1a PRIOR ART
FIG. 1*a* is a longitudinal cross-section of a conventional press roll piercer.

The following is detailed explanation of the press roll piercing process according to the present invention, in comparison with the conventional method:

Referring to FIG. 1, the conventional press roll piercing process is carried out by an apparatus in which a pushing cylinder 1 pushes a billet of square or rectangular cross-section 3-1 by means of a pusher rod 2 between rolls 4, 4'; and before and after said rolls 4, 4', there are provided, respectively, a container 5 and an outlet guide 6, for keeping the workpiece 3, that is, the billet 3-1 of square or rectangular cross-section and the round hollow shell 3-2 progressing along the mill center line — X → X; and the profiles of said rolls 4, 4', together define a round section roll pass, such section of the roll pass of said rolls 4, 4' having a center at which a plug is to be supported by a mandrel 8. Thus, the billet of square or rectangular cross-section 3-1 progresses due to the pushing force given thereto by the pushing cylinder 1 and the thrust force given thereto by the rolls 4, 4', so that said billet is pierced and expanded by the plug 7. The plug forms the inside surface of a round hollow shell, and the round outside surface is formed by roll profiles. Said round hollow shell 3-2 and the mandrel 8 are guided by guide rolls 10.

Figure 2:
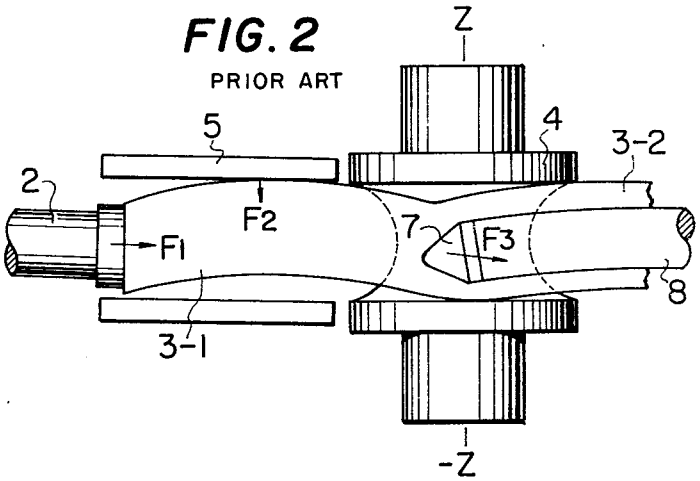
FIG. 2 PRIOR ART
FIG. 2 is a plan view of the piercer of FIGS. 1*a* showing the behavior of the workpiece during piercing.

As a result of studies made by the inventors of the present invention as to the cause of non-uniform wall thickness distribution in such a round hollow shell in the course of the production thereof by the piercing process, there has been found the following fact; in the course of piercing, the workpiece 3 (billet of square or rectangular cross-section 3-1 and round hollow shell 3-2) is in the condition shown in FIG. 2 in which the billet 3-1 which has been pushed between the rolls 4, 4' by the pusher rod 2, has become curved in the container 5 because of the clearance between the billet and the inside wall of said container, the thus curved workpiece having the convex side touching the inside wall of the container 5, so as to be reciprocated by the lateral force $\vec{F_2}$ working in response to the pushing force $\vec{F_1}$. In other words, the billet of square or rectangular cross-section 3-1, will be pushed into the roll pass by the resultant force $\vec{F_1} + \vec{F_2}$ working in a direction deviating from the mill center line —X → X, causing the deviant force $\vec{F_3}$ to work on the plug 7 at the tip of the mandrel 8. Accordingly, deflection of the mandrel 8 is produced in an amount depending on the flexural rigidity thereof, such deflection causing the non-uniform wall thickness distribution of the thus made round hollow shell. With $F_1$ being fixed, the greater the ratio of $\vec{F_2}/\vec{F_1}$, the greater the nonuniformity of the wall thickness distribution of the round hollow shell.

The ratio of $\vec{F_2}/\vec{F_1}$ becomes greater as the bending of the billet of square or rectangular cross-section 3-1 becomes greater. And the bending of such billet becomes greater as the clearance between said billet and the inside wall of the container 5 becomes greater. Therefore, the nonuniformity of the wall thickness distribution gets greater as the clearance becomes greater.

Figures 3, 4A, 4B, 4C, 4D, 5:
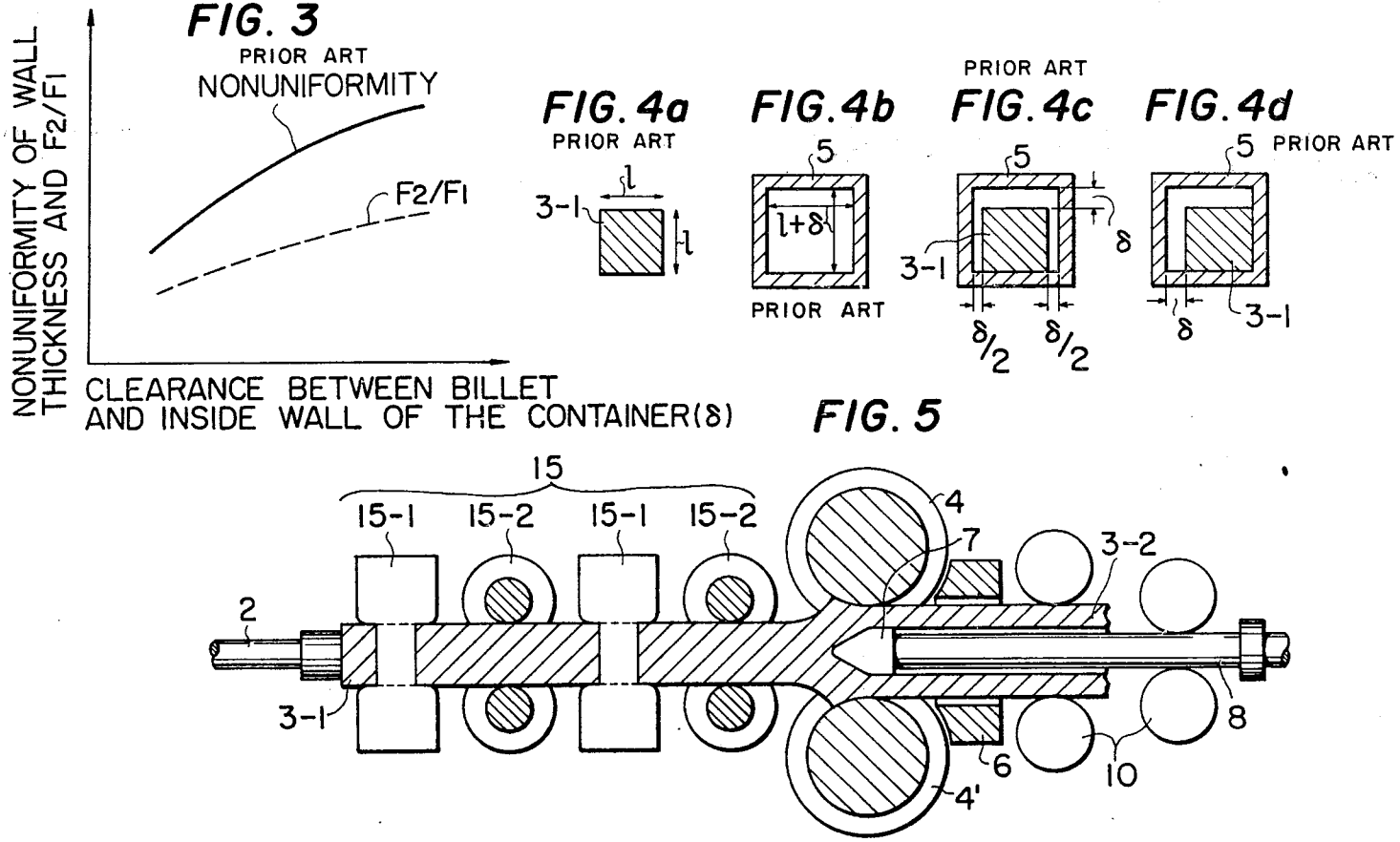
FIG. 3 PRIOR ART
FIG. 4a PRIOR ART
FIG. 4b PRIOR ART
FIG. 4c PRIOR ART
FIG. 4d PRIOR ART
FIG. 3 is a graph showing the relationship between the nonuniformity ratio of wall thickness and the clearance between a billet of square or rectangular cross-section and the inside wall of the entry guide.
FIGS. 4*a*—4*d* are cross-sectional views showing the relationship between the entry guide of the normal container type and a billet of square or rectangular cross-section.
FIG. 5 is a longitudinal section of one example of the entry guide of the guide roll type of the present invention.

FIG. 3 shows one kind of data for supporting the above description. In the drawing, the horizontal axis is the clearance $\delta$ between billets of square or rectangular cross-section 3-1 and the inside wall of the container 5; and the vertical axis is the nonuniformity of wall thickness and also $\vec{F_2}/\vec{F_1}$. As used herein, the nonuniformity of wall thickness means the ratio of the difference between the greatest and the smallest values of wall thickness relative to the mean wall thickness. As is clear from the drawing, both the uniformity of wall thickness and $\vec{F_2}/\vec{F_1}$ become steadily greater as the clearance between the billet of square or rectangular cross-section 3-1 and the inside wall of the container 5 increases, proving that there is a very close relationship between the nonuniformity of wall thickness and $\vec{F_2}/\vec{F_1}$.

From the material described above, it has been discovered that as steps to smooth out the nonuniformity of wall thickness distribution, the flexural rigidity of the mandrel 8 should be enhanced and the homogeneity of material should be enhanced, and uniformity of thermal distribution in the material or the clearance between the inside wall of the container 5 functioning as the guide on the inlet side and a billet of square or rectangular cross-section 3-1 should be reduced. The enhancement of the flexual rigidity of the mandrel 8 should be carried out by enlargement of the diameter thereof or a change of the material therefor.

However, a change of the material is not so effective for this purpose. Also, the diameter of the mandrel cannot be made greater than the inner diameter of the round hollow shell 3-2, and therefore there is a limit to the amount of the enhancement of the flexual rigidity.

Referring to FIG. 4, if the clearance $\delta$ between the billet of square or rectangular cross-section 3-1 and the inside wall of the container 5, is less than 5% of the side $l$ of the cross-section perpendicular to the direction of rolling pass of said billet 3-1; that is, $\delta \leqq 0.05l$ will not permit the workpiece 3 to progress readily, making it impossible to roll it. This proves that there is a limit to the amount of reduction of the clearance between the billet of square or rectangular cross-section 3-1 and the inside wall of the container 5. The reason for the stopping of the progress of the workpiece 3 at $\leq 0.05l$ is, as follows:

The billet of square or rectangular cross-section 3-1 is pressed between the tip of the pusher rod 2 and the rolls 4, 4' on the mill center line —X → X, such compression causing a deformation thereof so as to enlarge the cross-section area perpendicular to the direction of the rolling pass of the workpiece, sufficiently so that the length of the side of said billet is enlarged by nearly 5% in normal operations. Thus, the friction with the inside wall of the container 5 will increase greatly when the clearance $\delta$ is reduced to less than 5%, making the progress of the workpiece difficult.

As described above, the conventional press roll piercing process requires more than 5% clearance between the billet of square or rectangular cross-section 3-1 and the inside wall of the container 5, making inevitable a great nonuniformity of the wall thickness of the round hollow shell.

The above-described mechanism causing the non-uniform wall thickness distribution of the round hollow shell, which is inevitable in the conventional process, was fully studied in the development of the present invention, as a result of which the container 5 is not used as the guide for a billet of square or rectangular cross-section 3-1 between the rolls 4, 4', but instead a plurality of pairs of guide rolls 15 as shown in FIG. 5 are adopted for guiding the billet during its entry into the roll pass and the piercing by the mandrel and for holding the billet accurately on the mill center line —X → X. FIG. 5 illustrates an embodiment of the entry guidance by such guide rolls into the roll pass defined by the rolls 4, 4'. In the embodiment of FIG. 5, there are provided two pairs of horizontal rolls 15-2 each having a profile for defining a box-shaped roll pass therebetween and two pairs of similar vertical rolls 15-1. Thus four pairs of rolls together as guide rolls 15. As for the type of such guide rolls, any type such as a cylindrical roll with a straight linear profile is acceptable, as long as it can hold a billet of square or rectangular cross-section 3-1 accurately on the mill center line —X → X by subjecting the billet to forced guidance from four directions, running perpendicularly to the pass line, each two adjacent ones being at a right angle, through the whole distance over which the billet is guided. The guidance of the billet 5-1 is preferably applied from four directions, that is, from above and below, and from the left side and the right side; more preferrably the guidance from the former two directions is alternated with the guidance from the latter two directions. As for the number of guide rolls, it is not necessary to provide four pairs, but there may be provided one pair each of horizontal and vertical rolls. If possible, the guide rolls 15 next adjacent the inlet to the rolls 4, 4', should preferably be vertical rolls for the preventing of overfill. The result of the making of a round hollow shell by the press roll piercing process with the guide rolls 15 as described above for entry guidance, is that the non-uniform distribution of wall thickness is less than 10% on an average, while that of the round hollow shell made by the conventional press roll piercing process is about 25% on an average.

This improvement is the result of the practice of the present invention, according to which a billet of square or rectangular cross-section is guided during entry by guide rolls so that it is held on the mill center line —X → X accurately, there being no clearance at all, that is, 0 mm of clearance between the guide means and the billet.

The above-described guide rolls 15-1, 15-2 may be either rolls driven from a driving source and keeping pace with the movement of the workpiece 3, or rolls which are rotated by the movement of the workpiece 3 by the friction therewith, such as an idle roll. As for the clearance between the respective guide rolls 15 and a billet of square or rectangular cross-section 3-1, it should be zero, that is, the billet of square or rectangular cross-section 3-1 should just be contacting the surface of the respective guide rolls 15-1, 15-2; but for more accurate holding of the billet on the mill center line —X → X, the space between each pair of the respective guide rolls 15-1, 15-2, should be smaller than the side of the billet of square or rectangular cross-section, so as to reduce slightly the billet of square or rectangular cross-section 3-1. The pushing force required from the pusher rod 2 in this case is greater than that in the case of the conventional entry guidance by the container 5.

Figures 6A, 6B:
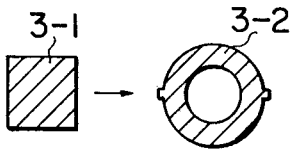
FIG. 6*a* is a cross-section of a billet right before entering the piercing mill where said billet is not reduced by the entrance guide rolls.
FIG. 6*b* shows the cross-section of a hollow shell just after it has been pierced from said billet of FIG. 6*a*, such hollow shell having over-fill.
Figures 6C, 6D:
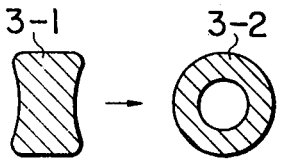
FIG. 6*c* shows the cross-section of a billet right before entering the piercing mill where said billet has been reduced slightly by the entrance guide rolls.
FIG. 6*d* shows the cross-section of a hollow shell just after it has been pierced from said billet of FIG. 6*c*, such hollow shell having no over-fill.

Furthermore, when there is more than one pair of the guide rolls 15, they may be forcedly driven, so as to reduce the billet of square or rectangular 3-1, thereby forming the cross-section of said billet into a shape desirable for the piercing to follow such reduction. Referring to FIG. 6, when a billet having the normal cross-sectional shape of FIG. 6 (*a*), is subjected to press roll piercing, there is a danger of overfill in the pass between the vertical rolls resulting in slight flashing along the sides of the tube.

However, if a billet of square or rectangular cross-section has been reduced at the portion facing the gap between the vertically arranged rolls into a cross-sectional shape having a concave portion as illustrated in FIG. 6 (*c*), the piercing of such shape of the billet will produce a round hollow shell 3-2 as illustrated in FIG. 6 (*d*). Such reduction is done by a pair of vertical rolls each having the cross-sectional shape of a barrel with an enlarged central portion. At the narrowest portion of the pass (at its central portion), the reduction rate of the billet (which is greatest at said narrowest portion) is roughly less than 5%.

Also, the reduction of billet by guide rolls makes it possible to smooth out any heavy deformity of continuous cast billets or the corners thereof, into a cross-sectional shape suited for piercing. Even in such rolling, the appropriate reduction rate is less than 5%.

Furthermore, the forced driving of the guide rolls as described above, supplies a thrust force to the billet, to making it possible to operate with a weaker pushing force working on the billet. Because of the use of a weaker pushing force, it is possible to prevent buckling between the pusher and the guide rolls.

As described above again and again, the cross-sectional shape of billet is not limited to a square, but may be rectangular. When a billet of rectangular cross-sectional shape is rolled, it should be inserted between rolling rolls so as to be rolled in the longitudinal direction.

Using the structure and causing it to function as described above, the press roll piercing process according to the present invention can produce a hollow shell having only a small nonuniformity of wall thickness and having no overfill.

In the meantime, even though the workpiece 3 (that is, a billet of square or rectangular cross-section 3-1 or a hollow shell 3-2 as the case may be) is caused to progress along the mill center line —X → X by the entry guide rolls 15, rolling rolls 4 and 4' outlet guide 6 and guide rollers 10, and even though the mandrel 8 is caused to lie on the mill center line —X → X by the guide rollers 10, the non-uniform heat distribution in the billet, and lack of homogeneity of the material, causes bending of the mandrel to take place as a result of the continuous piercing operation, and causes the plug 7 to deviate from the mill center line —X → X, such deviation sometimes resulting in a non-uniform wall thickness of the hollow shell 3-2. Therefore, the present invention has the apparatus for carrying out the method so designed that one or more of the entry guide rolls 15, rolls 4, 4' outlet guide 6 and guide rollers 10 is shifted from the position along the mill center line —X → X, thereby reducing nonuniformity of the wall thickness.

The principle of the present invention is explained more in detail, as follows. Referring to FIG. 5, if the entry guide rolls 15 are shifted parallel with the direction the Y axis (for the axis, refer to FIG. 1) the billet of square or rectangular cross-section 3-2 simultaneously moves in the same direction, causing a deviation of the flow of the workpiece in the direction of the Y axis in the vicinity of the plug 7; therefore, the wall thickness distribution after the piercing step is increased in the direction of Y and decreased in the direction of —Y. Therefore, when the wall thickness of the workpiece during the rolling and piercing step is increased non-uniformly in the direction of the Y axis, the shifting of, say, the entry guide rolls 15 in the direction of —Y, will reduce such wall thickness, reducing the nonuniformity of wall thickness. The shifting of the entry guide rolls may cause non-uniform wall thickness of the billet of square or rectangular cross-section, and therefore, said shifting should not necessarily be made parallel with the mill center line, but it may be made at a certain angle inclined to the pass line, so that such shifting can change the entry angle of the billet, so that the relationship between the direction of slant shifting of the entry guide rolls and nonuniformity of the wall thickness of the thus rolled hollow shell, is similar to the abovementioned case where the entry-sided guide rolls are shifted parallel with the pass line. If, the entry-sided guide rolls 15 are turned clockwise, relative to the origin of the coordinates shown in FIG. 1, the round hollow shell 3-2 have the wall thickness increasing in the upward direction and decreasing in the downward direction.

If the outlet guide 6 is shifted parallel with the direction of the Y axis, and also if it is provided in the vicinity of the rolls 4, 4' and the flexural rigidity of the mandrel is high enough for practical use, the guides push the workpiece 3 in the shifting direction, and the mandrel 8 and the plug 7 are moved in the same direction by the workpiece 3, so that the plug 7 tends to deviate in the direction of Y during operation. Therefore, the hollow shell after the piercing step has a wall thickness decreasing in the direction of Y and increasing in the direction of —Y.

If the wall thickness of the hollow shell is increased non-uniformly in the direction of the Y axis, the outlet guide 6, for example, should be shifted parallel with the direction of Y axis. Also if the outlet guide is shifted to a slant position, a similar effect can be attained to that attainable in the case of parallel shifting thereof, for the same reason as described above.

The case where the position of the mandrel 8 is shifted to the mill center by means of the outlet guide rollers 10, can be explained in the same way as the abovementioned case of the outlet guide 6, that is, the position of the guide outlet rollers 10 should be as close to the rolls 4, 4' as possible; otherwise, the mandrel may bend all the time, making it impossible to effectively control the uniformity of wall thickness.

In the general case, several sets of guide rollers 10 are provided; but in the practice of the present invention, the guide rollers 10 which are positioned closest to the rolls 4, 4' should preferably be shifted in the direction of the outlet guide, shifting thereof at the same time being most desirable, and the guide rollers 10 constituting the second pair from the rolls 4, 4' should be shifted a little in the direction of the outlet guide 6 at the same time.

The above explanation of the controlling process according to the present invention has been made with respect to the direction of the Y axis, that is, the vertical direction, but the same explanation as given above, can be made also with respect to the direction perpendicular to the direction of the Y axis, that is, the horizontal direction.

In the meantime, there are three method available for the detection of nonuniformity of the wall thickness of the hollow shell during the making thereof.

The first method is to detect the non-uniformity by the detection of the temperature difference in the vertical and the horizontal direction of the hollow shell during its manufacture.

In the case of piercing steel workpieces, a billet of square or rectangular cross-section, is previously heated to about 1,300° C, and then pierced by a press roll piercer.

Figure 1D:
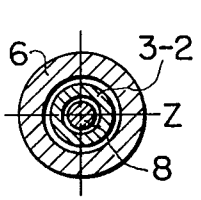
FIG. 1d PRIOR ART
FIG. 1*d* is a cross-section taken on the line B—B′ of FIG. 1*a;*
Figure 1C:
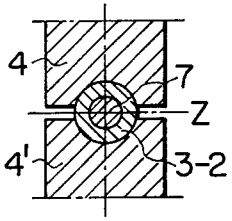
FIG. 1c PRIOR ART
FIG. 1*c* is a cross-section taken on the axis Y of FIG. 1*a′;*
Figure 1B:
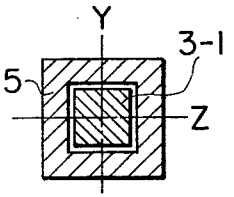
FIG. 1b PRIOR ART
FIG. 1*b* is a cross-section on the line A—A′ of FIG. 1*a;*

Even though the billet of square or rectangular cross-section 3-1 starts being pierced with the temperature distributed equally in the vertical direction (in the direction of the Y axis) as well as in the horizontal direction (in the direction of the Z axis), referring to the cross-section A—A' of FIG. 1*b*, the plug 7 and the mandrel 8 deviate as rolling progresses, thereby causing the wall thickness of the hollow shell to decrease in a specified direction on the cross-section B—B' of FIG. 1*d* and increasing at the position opposite thereto, that is, 180° therefrom.

In that case, the temperature of the hollow shell falls due mainly to heat radiation and the heat transfer to the outlet guide 6 and to the mandrel; the temperature fall is increased when the wall thickness is thinner. Therefore, if the hollow shell 3-2 is measured for the temperature $t_1$ in the direction Y, for the temperature $t_2$ in the direction for Z, the temperature $t_3$ in the direction —Y, and for the temperature $t_4$ in the direction —Z, the temperature difference, that is, the direction and amount of the temperature difference can be obtained by using the positional relation of coordinates T ($t_2 - t_4$, $t_1 - t_3$) and T(0, 0), and then control of the non-uniform wall thickness can be carried out so as to attain the desired values, $t_2 - t_4 = 0$ and $t_1 - t_3 = 0$.

A second method is to obtain the wall thickness difference in the hollow shell 3-2 from the radiation transmission difference by a radioactive isotope provided inside the mandrel 8.

It is well known that the transmission of radiation changes nearly inversely proportionally to the thickness of plate. This relationship should apply also to a cylinder, if a radioactive source is provided at the center thereof.

Therefore, if Geiger counters are provided on the outlet side of the rolls 4, 4' respectively for the vertical and the horizontal directions, for measuring the transmission of radiation, it is possible to obtain the direction and amount of the wall thickness difference of hollow shell in the same manner as in the case of the control of the nonuniformity of wall thickness by the measurement of temperature difference. A third method is to determine the direction and amount of non-uniform wall thickness by utilizing the relations of rolling load on the rolls 4, 4', roll thrust and roll torque.

Figure 7:
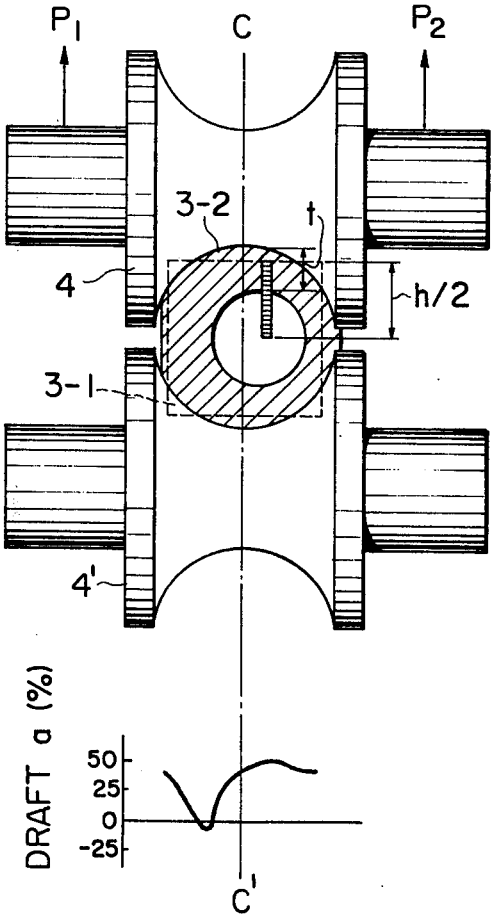
FIG. 7 is an explanatory view of the relationship between rolling loads respectively on the working side and the driving side and the non-uniformity of the wall thickness produced in the direction of the axis of the rolling rolls.

As shown in FIG. 7 which is an explanatory view to show the rolling load, where axial line of the hollow shell 3-2 shifts parallel with the axis of the rolling rolls, the draft a can be expressed by the following formula:

$$a = (h - 2t) \times 100/h \ (\%)$$

where:

*h:* Thickness in the perpendicular direction of billet of square or rectangular cross-section 3-1

*t:* Thickness in the perpendicular direction of hollow shell 3-2 at said position.

Figure 8:
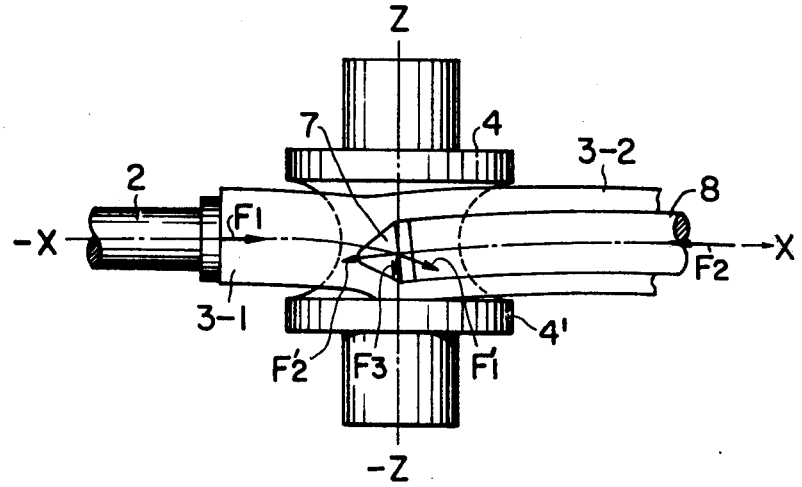
FIG. 8 is an explanatory view of the relationship between the direction of thrust of the rolling rolls and the non-uniformity of the wall thickness produced in the direction of the axis of the rolling rolls.

This formula proves that with respect to the central vertical axis (C, C') of the pass, the draft of hollow shell is increased on the side having the lesser wall thickness. The rolling load increases generally with the increase of the draft, and therefore, there is a relationship of $F_2 > F_1$ between $P_1$ and $P_2$ which are rolling loads, and the load deviation in the direction of the roll axis is represented by $\Delta P = P_2 - P_1$. (The measurement of the rolling load is made generally at the same time on the working and the driven sides.) Referring to FIG. 8 which is an explanatory view to show roll thrust, if forces $F_1$ and $F_2$ are given to the workpiece 3 respectively by the pusher rod 2 and by the mandrel 8 parallel with the X axis and if the hollow shell 3-2 wall thickness becomes non-uniform in the direction of the Z axis, the plug 7 within the pass deviates toward the thin wall partion of the hollow shell 3-2, thereby producing reaction roll thrust $F_3$.

The roll thrust $F_3$ can be measured by inserting a pressure transmitter between the housing and roll chock.

Figure 9:
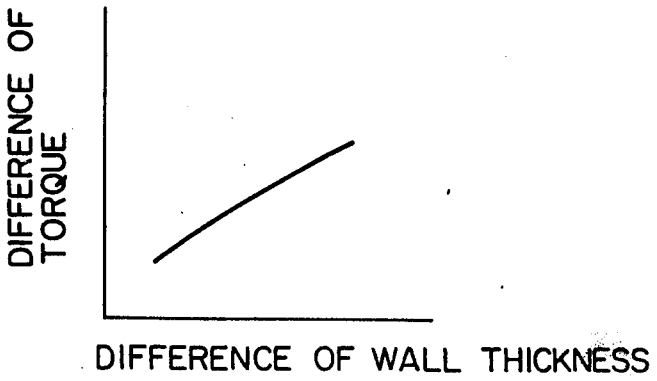
FIG. 9 is a graph showing the relationship between the difference of torque of the two rolling rolls and the difference in wall thickness in the direction of the bottom of the roll pass.

As is understandable from FIG. 9 showing an experimental relationship between the torque difference of the upper and the lower rolls and the non-uniform wall thickness in the vertical direction, roll torque increases on the side of the greater wall thickness.

Thus, the detection can be carried out by detecting the nonuniformity of the thickness of the hollow shell in the direction of roll axis, by rolling load or roll thrust, and nonuniformity in the direction of the roll profile, by roll torque.

Figure 10:
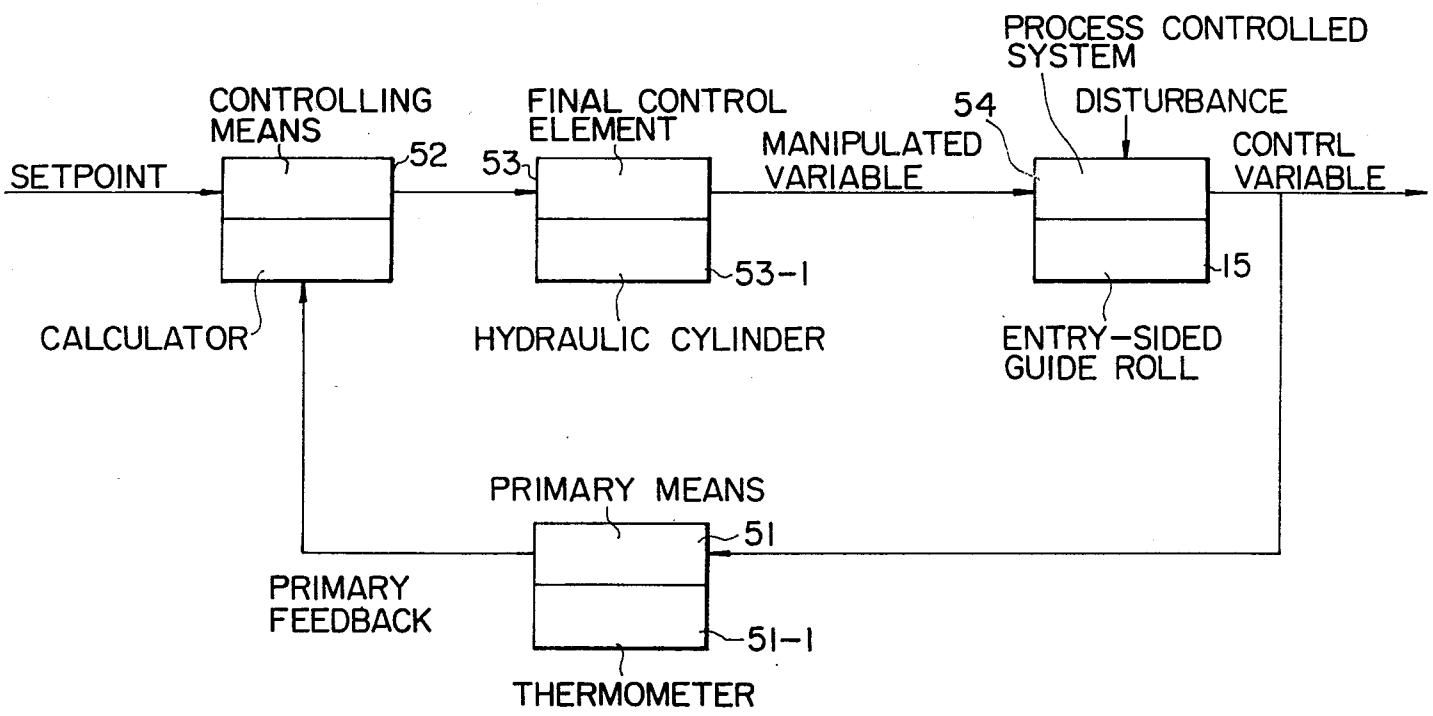
FIG. 10 is a block diagram of the controlling system for the apparatus for carrying out the method according to one embodiment of the present invention.

The following is an explanation of the controlling system by which the method of the present invention can be carried out:

Referring to FIG. 10, the temperature of the hollow shell 3-2 is detected by four schematically represented thermometers 51-1 of the primary temperature detector 51, in the upper and lower and in the bilateral directions of the hollow shell 3-2, such detected temperatures being used to determine the horizontal temperature difference $\Delta t_H$. When $\Delta t_H = O$ control means 52 issues a signal to the final control element 53, which controls the hydraulic cylinder 53-1 so as to adjust the position of the entry guide rolls 15, by a control means 54, from the mill center line —X → X. Control of operations for reducing nonuniformity of the wall thickness in the vertical direction is carried out in the same way as described above.

With the step of piercing that was described above as being capable of producing a hollow shell of small nonuniformity in wall thickness, there can be combined various rolling steps. For example, the piercing step according to the present invention, may be followed by a Pilger mill for carrying out one of such rolling steps.

The below mentioned embodiment of the present invention is the case of the piercing step being followed by rolling steps. As described above, the piercing step according to the present invention can produce hollow shell of small nonuniformity in wall thickness, so that it will not be necessary to smooth the wall having a non-uniform thickness distribution; there can still be produced a high quality steel tube having nearly no surface defects as well as a small non-uniform wall thickness distribution. Also, the method disclosed in this embodiment is effective in the production of seamless steel tube having a comparatively thin wall thickness and of medium diameter (about 5 – 16 inches outside diameter).

Figures 11, 12A, 12B, 12C, 12D:
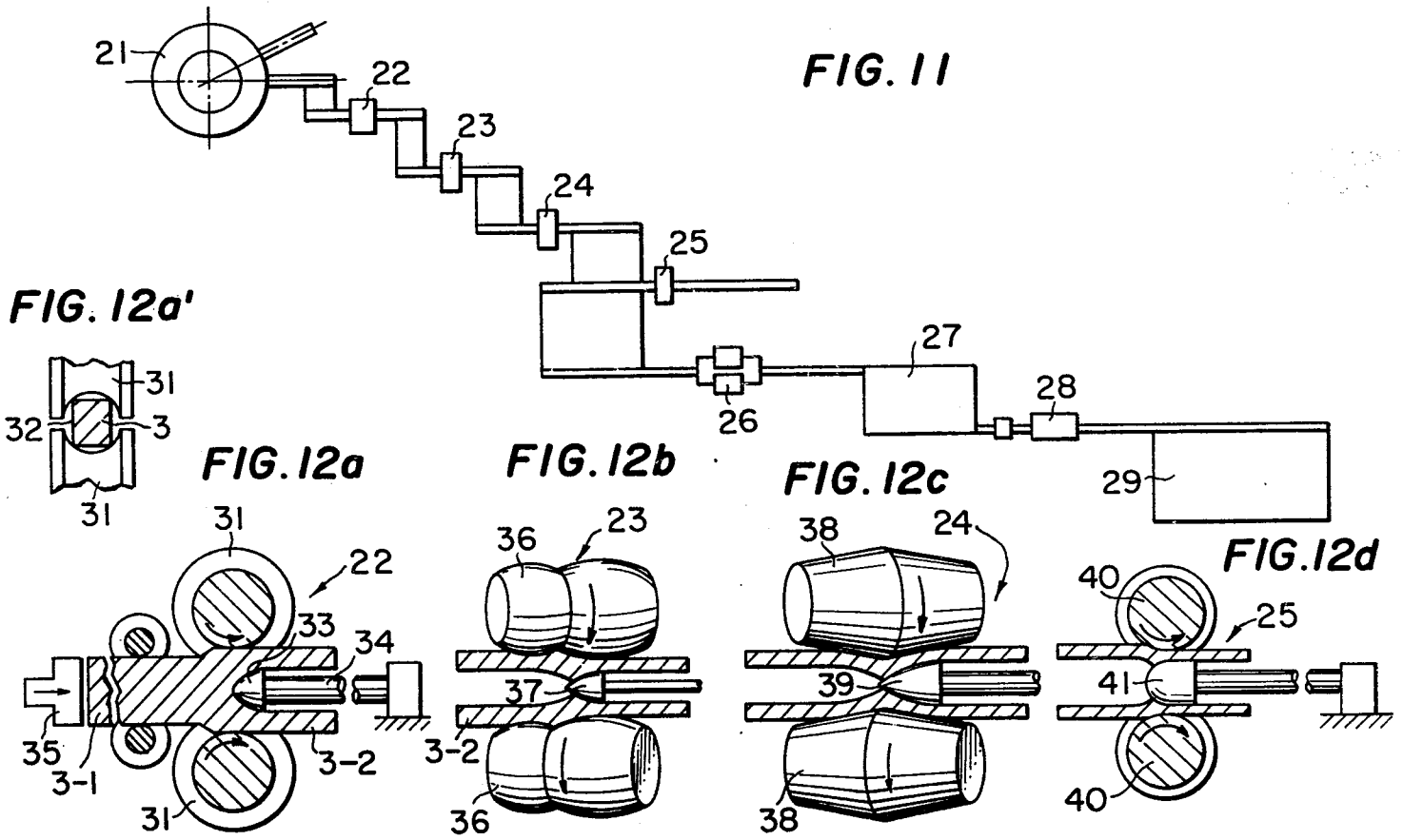
FIG. 11 shows the layout of a rolling mill for the production of seamless steel tube by the method of the present invention.
FIGS. 12*a* – 12*d* are explanatory views of the main steps of the steel tube production in the rolling mill of FIG. 11.

FIG. 11 shows a layout of a plant for the production of seamless steel tube by such steps as described in the above embodiment.

After having been heated in a heating furnace 21, a billet of square or rectangular cross-section is pierced by a piercing mill 22 of the press roll type according to the present invention.

The thus obtained hollow shell is rolled by an equalizer 23, at which rolling step the non-uniform wall thickness distribution of the hollow shell caused in the previous rolling step, is further reduced.

Then, the wall thickness is reduced by an elongator 24 to the thickness required for rolling by a plug mill.

After that, the hollow shell is rolled for finishing by a plug mill 25, in the same manner as conventionally, and then, it is rolled by a reeler 26 for changing the size and surface properties. Then, the tube is reheated in a reheating furnace 27, and finished by a sizer 28 into the final product size. Then, it is sent to a cooling bed 29.

As described above, the method of the present invention is characterized by the piercing of a billet by a piercing mill of the press roll type 22, the roughing by an equalizer 23 and an elongator 24 and the finishing-rolling by a plug mill 25.

The following is detailed explanation of said embodiment of the present invention in reference to FIG. 12.

The piercing step is the same as described in the above explanation of the piercing process, but the strain rate of billet and the elongation ratio are respectively about 1 $sec^{-1}$ and about 1.0 – 1.3, which are much smaller than according to the conventional processes, so that there will be produced hardly any defects on the workpiece by piercing, thereby making it possible to use an inferior quality (in terms of inclusions and structure) of billet as compared to those usable for the conventional piercing processes, even continuously cast steel and alloy steel without difficulty.

Referring to FIG. 12(*b*), the equalizer 23 consists of a pair of special rolls 36 and a plug 37, and the hollow shell 3-2 is subjected to cross-rolling by the special rolls 36 which are positioned with their axes arranged crossing each other, said hollow shell containing the plug 37 inside. In this rolling operation, the change in the outer diameter of the hollow shell 3-2 and the elongation ratio thereof should desirably be respectively + 5 to −12% and 1.2 – 2.5, depending on the size of the rolled product, thus greatly reducing the nonuniformity of wall thickness of the hollow shell 3-2. As for the shape of rolls of the equalizer 36, they should desirably be humped, as shown in FIG. 12 (*b*), but they may be barrel type rolls 38 like those of the elongator 24, as this is nearly as effective in reducing the nonuniformity of wall thickness as the humped rolls, so far as rolling is done within the condition of said ranges.

The rolling with the elongator 24 subsequent thereto, is done fundamentally in the same way as conventionally, as shown in FIG. 12(*c*), but the change in the outer diameter of the hollow shell and the elongation ratio thereof should desirarably be respectively 0 to + 15% and 1.5 – 3 depending on the size of the rolled product. Furthermore, if the rolling speed in the axial direction is between 0.4 and 0.6 m/sec., the temperature drop of the hollow shell during this step can be made smaller, making it possible to omit the reheating process which should otherwise be included between this step and the rolling with the plug mill 25.

Referring to FIG. 12(*d*), the finishing-rolling according to the present invention is carried out in the same way as conventionally, that is, by using the plug mill 26 consisting of a pair of rolls 40 forming a semi-circular pass, and a plug 41, at an elongation ratio of 1.2 – 1.8.

As described above, the production of seamless steel tube according to the present invention is carried out so that a billet of square or rectangular cross-section is pierced into a round hollow shell, at a low strain rate and a low elongation ratio; then, the tube is rolled mainly for reducing the non-uniform wall thickness distribution in the subsequent rolling step at a comparatively low elongation ratio and a comparatively low outer diameter change ratio and furthermore the tube is rolled into a smaller wall thickness; and finally it is rolled for finishing by the plug mill.

In case roughing is done by one elongator according to the present invention, instead of using two kinds of mills, that is the equalizer 23 and the elongator 24, rolling load working on said single elongator will become so great that the elongation ratio in the case of producing steel tube having a small wall thickness will be 5 or 6. Therefore, in such case of rolling steel tube having a small wall thickness, no effective reduction of the nonuniformity wall thickness can be expected. Furthermore, the temperature drop at the top side of rolled product is great in the rolling operation under the abovementioned conditions, generally because the rolling speed of the axial direction is limited to about 0.2 m/sec.

This makes it necessary to provide a reheating step before the rolling by the plug mill, constituting a disadvantage from the standpoint of improvement of surface quality. The following is a description of the effect of the method of the present invention in comparison with the conventional process and by using production equipment on a commercial scale. This embodiment handled the production of a tube 216.3 mm in outer diameter and 5.8 mm in wall thickness from a billet of square cross-section of 186 mm in side length. Table 1 shows the operation conditions of this embodiment of the present invention and also of the conventional processes.

Table 1

| Steps | | Material | Piercing | Roughing | | Finishing | Reeling-rolling | Sizing-rolling | |
|---|---|---|---|---|---|---|---|---|---|
| | | — | Piecer | | Elongator | Plug mill | Equalizer Reeler | Sizer | Remarks |
| Present invention | Outer dia.(mm) | 186 mm $\phi$ | 225 | 223 | 225 | 216 | 234 | 216.3 | Total |
| | Thickness(mm) | (Continuously | 56.2 | 27.0 | 9.1 | 6.1 | 5.6 | 5.8 | Elongation |
| | Elongation | cast) | 1.1 | 1.79 | 2.68 | 1.53 | 1.0 | 1.0 | ratio 7.0 |
| Conventional Processes | Outer dia.(mm) | 185 mm $\phi$ | 186 | — | 225 | 216 | 234 | 216.3 | Total |
| | Wall thickness (mm) | (Rolled) | 25.5 | — | 9.1 | 6.1 | 5.6 | 5.8 | Elongation |
| | Elongation | | 2.05 | — | 2.08 | 1.53 | ratio 7.5 1.0 | 1.0 | |
| ratio | | | | | | | | | |

Figure 13:
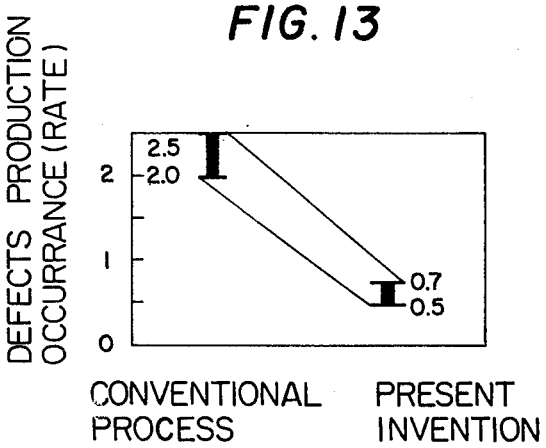
FIG. 13 is a graph showing a comparison between the method of the present invention and the conventional process with respect to defect occurance in the production of carbon steel tube.
Figure 14:
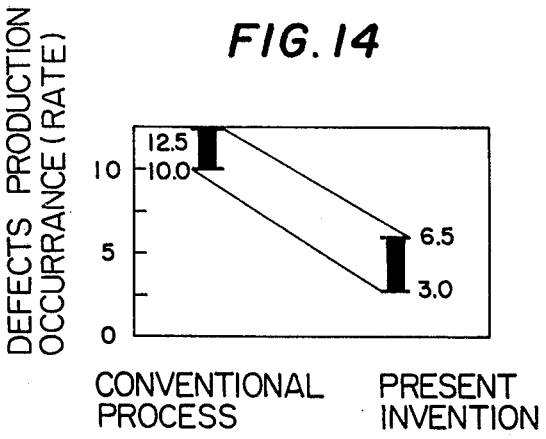
FIG. 14 is a graph showing a comparison between the method of the present invention and the conventional process with respect to the nonuniformity of wall thickness.
Figure 15:
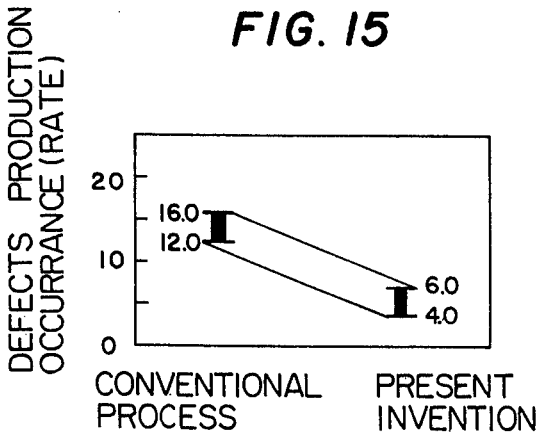
FIG. 15 is a graph showing a comparison between the method of the present invention and the conventional processes with respect to defect occurance in the production of alloy steel tube.

FIGS. 13 and 14 show respectively the occurrance of surface defects and the nonuniformity of wall thickness, in comparison with those according to the conventional process. As clearly shown in these graphs, the occurrance of surface defects according to the present invention, is about one fourth of that according to the conventional processes; and the nonuniformity of the wall thickness is about half of that according to the conventional processes. Referring to FIG. 15, the occurrance of surface defects even when using alloy steel (5 Cr steel, 9 Cr — 1 Mo steel) decreases to half or one third according to the present invention, compared with the occurance according to the conventional processes.

What is claimed is:

1. A method of producing seamless shell tube of uniform wall thickness, which comprises applying a force to a billet having an unapertured square or rectangular cross-section for pushing the billet forward along the longitudinal axis thereof;

applying a plurality of guide rolls to said billet spaced along the length of the path of the billet as it is moving forward under said pushing force for forcedly guiding the billet to keep the axis of said billet in alignment with a piercing plug at the center of the roll pass of a piercing mill; and while said billet is moving forward under the effect of said pushing force and also is being forcedly guided, forcing said billet through the roll pass defined by a pair of rolling rolls mounted one above the other in the piercing mill for reducing the cross-section of said billet and rounding it and at the same time forcing the billet over the plug supported between said rolling rolls at the center of the cross-section of the roll pass for piercing the billet.

2. The method as claimed in claim 1 in which the plurality of guide rolls are applied to said billet from four directions, all of which are perpendicular to said center line of the roll pass, said directions each being perpendicular to the next adjacent direction.

3. The method as claimed in claim 1 in which said plurality of guide rolls are forcedly applied to said billet for slightly reducing the billet by giving to the opposite side faces of the billet a slightly concave shape, whereby the billet is prevented from overfilling the roll pass during the forcing of the billet through the roll pass.

4. The method as claimed in claim 1 in which the plurality of guide rolls are applied to the billet in opposed pairs, the successive pairs of guide rolls alternately applying the guiding force to the billet from above and below the billet and from opposite sides of the billet.

5. The method as claimed in claim 1 in which said step of applying the guide rolls comprises driving the guide rolls.

6. The method as claimed in claim 1 in which said step of applying the guide rolls comprises forcedly applying the guide rolls to the billet for reducing the billet at a reduction rate of less than 5%.

7. The method as claimed in claim 1 further comprising detecting the differences in the amount and direction of any non-uniformity in the thickness in the wall of the rolled tube on opposite sides of the tube as the billet is pierced and rolled in the roll pass, and adjusting the guide rolls in a direction transverse to the axis of the billet in an amount dependant on the difference in the thickness and the direction thereof for bringing the axis of the billet more into alignment with the plug in the roll pass for reducing the non-uniformity of the wall thickness of the rolled tube.

8. The method as claimed in claim 7 wherein said differences in the amounts and direction of the non-uniformity of the thickness in the wall of the rolled tube is detected by detecting differences in the temperature of the rolled tube on the top and bottom thereof and on opposite sides thereof.

9. The method as claimed in claim 7 wherein said differences in the amounts and direction of the non-uniformity of the thickness in the wall of the rolled tube is detected by transmitting radiation through the wall of the tube and detecting the amounts of radiations transmitted through the wall of the tube at various positions around the tube.

10. The method as claimed in claim 1 wherein said differences in the amounts and direction of the non-uniformity of the thickness in the wall of the rolled tube in the direction of the axis of the rolling rolls is detected by detecting the difference between the rolling loads on the rolling rolls and the amount and direction of the non-uniformity of the thickness in the wall of the rolled tube in the direction perpendicular to the axis of the rolling rolls is detected by detecting the difference between the amount and direction of the torque on the upper and lower rolling rolls.

11. The method as claimed in claim 1 wherein said differences in the amounts and direction of the non-uniformity of the thickness in the wall of the rolled tube in the direction of the axis of the rolling rolls is detected by detecting the direction and amount of thrust on the roll axis of the rolling rolls, and the amount and direction of the non-uniformity of the thickness in the wall of the rolled tube in the direction perpendicular to the axis of the rolling rolls is detected by detecting the difference between the amount and direction of the torque on the upper and lower rolling rolls.

12. The method as claimed in claim 1 further comprising detecting the differences in the amounts and direction of any non-uniformity in the thickness in the wall of the rolled tube on opposite sides of the tube as the billet is pierced and rolled in the roll pass, and adjusting outlet guide means on the outlet side of said roll pass taken from the group consisting of an outlet guide member and outlet guide rolls for bringing the axis of the rolled tube more into alignment with the plug in the roll pass for reducing the non-uniformity of the wall thickness of the rolled tube.

* * * * *

UNITED STATES PATENT AND TRADEMARK OFFICE

CERTIFICATE OF CORRECTION

PATENT NO. : 4,006,618

DATED : February 8, 1977

INVENTOR(S) : SAMON YANAGIMOTO et al.

It is certified that error appears in the above-identified patent and that said Letters Patent are hereby corrected as shown below:

In the heading line for"Assignees Samon Yanagimoto;"

substitute --Assignee:--.

Signed and Sealed this

Twelfth Day of April 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,006,618

DATED : February 8, 1977

INVENTOR(S) : SAMON YANAGIMOTO et al

It is certified that error appears in the above-identified patent and that said Letters Patent are hereby corrected as shown below:

Table 1 column 1 delete "ratio" at bottom of column;
column 2 at bottom of column add --ratio--;
column 5 add heading --Equalizer--;
column 8 delete "Equalizer" from heading and delete "ratio 7.5" in next last line;
column 10 beneath "Elongation" at bottom of column add --ratio 7.5--.

Fig. 14 for Legend along ordinate read --NON UNIFORMITY OF WALL THICKNESS (%).

UNITED STATES PATENT AND TRADEMARK OFFICE

CERTIFICATE OF CORRECTION

PATENT NO. : 4,006,618 Page 2 of 2

DATED : February 8, 1977

INVENTOR(S) : SAMON YANAGIMOTO et al

It is certified that error appears in the above—identified patent and that said Letters Patent is hereby corrected as shown below:

For the Figure on cover page beneath Abstract substitute the attached Figure.

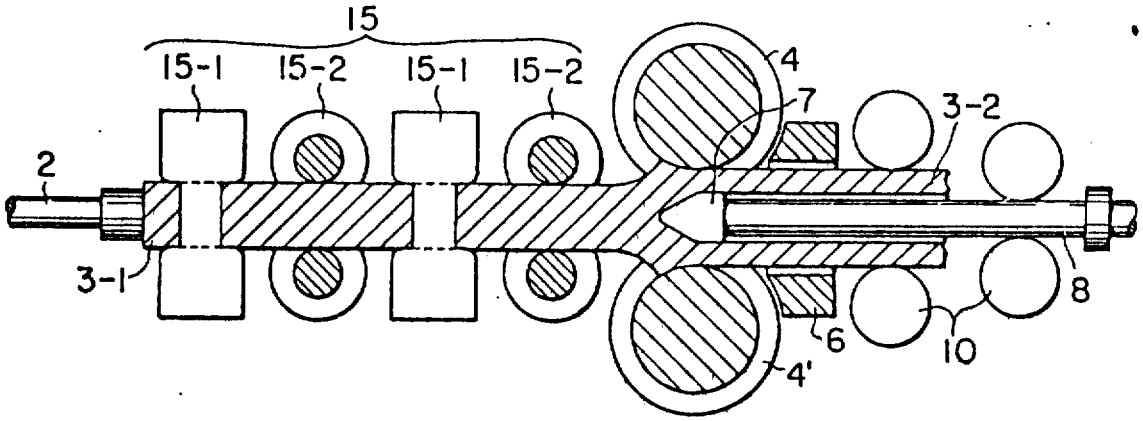

Signed and Sealed this

Twenty-ninth Day of December 1981

[SEAL]

Attest:

GERALD J. MOSSINGHOFF

Attesting Officer

Commissioner of Patents and Trademarks